United States Patent [19]

Kobayashi

[11] Patent Number: 4,652,740

[45] Date of Patent: Mar. 24, 1987

[54] INFRARED RAY TARGET FOR MODEL GUN

[75] Inventor: Tazo Kobayashi, Urawa, Japan

[73] Assignee: The Collector's Armoury, Inc., Alexandria, Va.

[21] Appl. No.: 684,838

[22] PCT Filed: Apr. 13, 1984

[86] PCT No.: PCT/US84/00563

§ 371 Date: Dec. 14, 1984

§ 102(e) Date: Dec. 14, 1984

[87] PCT Pub. No.: WO84/04155

PCT Pub. Date: Oct. 25, 1984

[30] Foreign Application Priority Data

Apr. 15, 1983 [JP] Japan ..... 58-65203

[51] Int. Cl.[4] ..... H01J 40/14; F41J 5/04

[52] U.S. Cl. ..... 250/215

[58] Field of Search ..... 250/215; 273/371, 316, 273/310, 311, 378

[56] References Cited

U.S. PATENT DOCUMENTS 4,269,415 5/1981 Thorne-Booth ..... 273/310

4,296,929 10/1981 Meyer et al. ..... 273/310

*Primary Examiner*—Gene Wan

*Attorney, Agent, or Firm*—Lowe Price Leblanc Becker & Shur

[57] ABSTRACT

A model gun (MG) generates an infrared beam (L) simultaneously with ignition of a gun powder cap. The infrared beam is detected by a sensor (2) positioned in the center of a target. In response to a "hit", different forms of visual display are generated.

11 Claims, 10 Drawing Figures

INFRARED RAY TARGET FOR MODEL GUN

TECHNICAL FIELD

This invention relates generally to a target responsive to infrared rays generated by a model gun.

BACKGROUND ART

Generally, targets for model guns respond to visible rays. The visible ray source within the gun, however, causes the gun to be large in size and weight. This is a serious problem in a model gun, wherein the touch, external appearance and design of the actual revolver are respected while compactness and performance accompanied by light, sound and smoke are required. Available model guns do not meet these requirements.

DISCLOSURE OF INVENTION

Infrared rays are generated in a model gun when a gun powder cap explodes within a powder chamber. The infrared rays are directed forward of the gun, with the gun barrel conduit providing a high degree of directivity. Infrared rays are received by a target which operates only when the gun is fired accurately at a predetermined central point. When the gun is fired at other areas of the target, the volume of infrared rays received by a sensor located at the center of the target is too small to be detected. Special skill is, therefore, required to fire the gun, enhancing the pleasure of play and improving marksmanship.

An object of the invention, therefore, is to provide a device to determine whether infrared rays generated from a model gun are projected accurately onto a central portion of the target. A secondary object is to provide in the target diversified display functions, such as score counting and lighting.

Another object is to provide a gun target for marksmanship training wherein live ammunition is not used but the "feel" of an actual gun is provided.

BEST MODE FOR PRACTICING THE INVENTION

Figure 1:
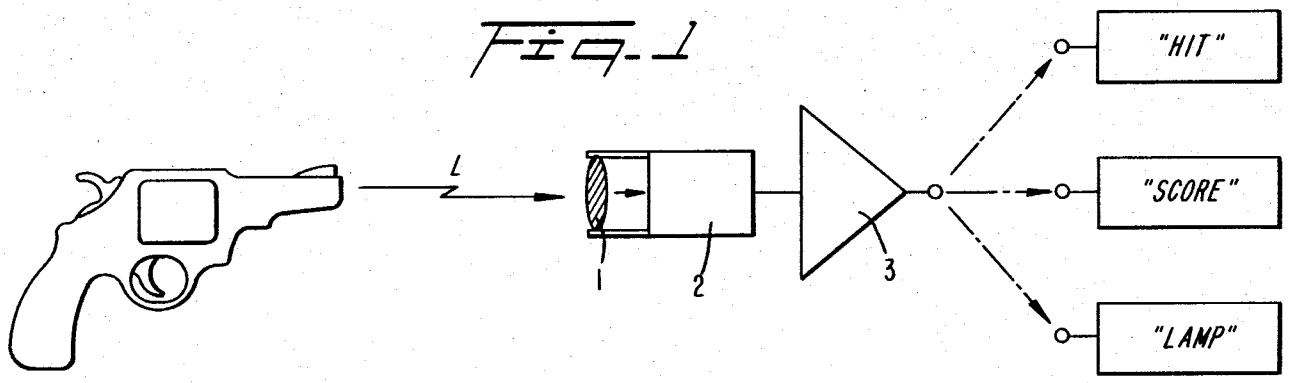
FIG. 1 is a block diagram of the invention.

In FIG. 1, infrared rays L generated by a model gun (not numbered) coincident with the explosion of a gun powder cap is projected along the extension line of the gun barrel. A light receiving sensor 2, responsive to the infrared rays through lens 1, develops a signal that is amplified by amplifier 3 to operate scoring and lighting devices in accordance with the invention.

Figure 2B:
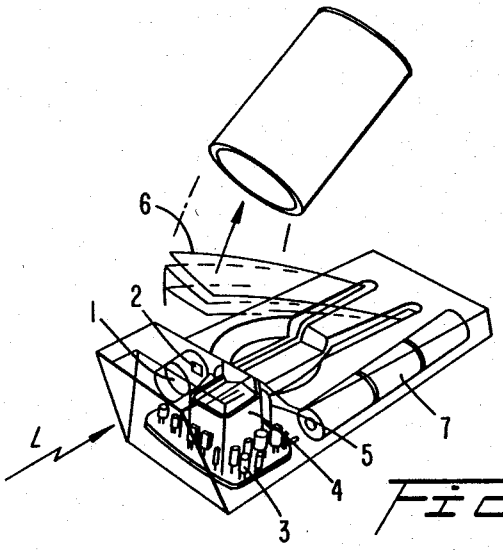
FIG. 2*b* is a perspective view of the object projector symbolized in FIG. 2*a;*
Figure 2A:
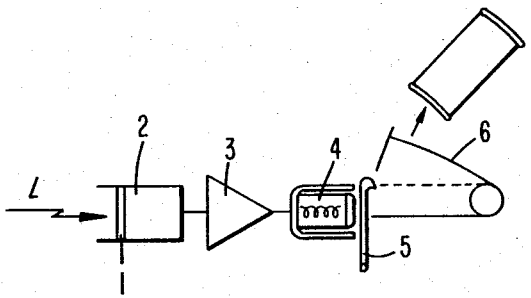
FIG. 2*a* is a diagram of a relay for projecting an item in response to a "hit"

In FIG. 2, a relay RY is closed in response to the output of sensor 2 which in turn indexes electromagnet 4 interlocked with the relay RY. Movement of the electromagnet indicates that the center of the target whereat the light receiving sensor 2 is located has been hit by infrared rays. Spring stopper 5 is thus indexed, shown in FIG. 2*b,* to release a spring wire 6, which is elastic and bent into a U-shape or provided in the form of a spring. The wire 6 may project a device, such as a small can be shown, placed on the body of the wire. Since the spring stopper 5 is installed such that its end hook can be released from the wire as the stopper is indexed by the electromagnet, the wire recoils upon release, projecting the can. This display is evidence that the infrared rays projected by the gun have struck the center of the target.

When the volume of the infrared ray L is reduced, indicating that the gun is aimed off target center, the relay RY is turned off.

Figure 2C:
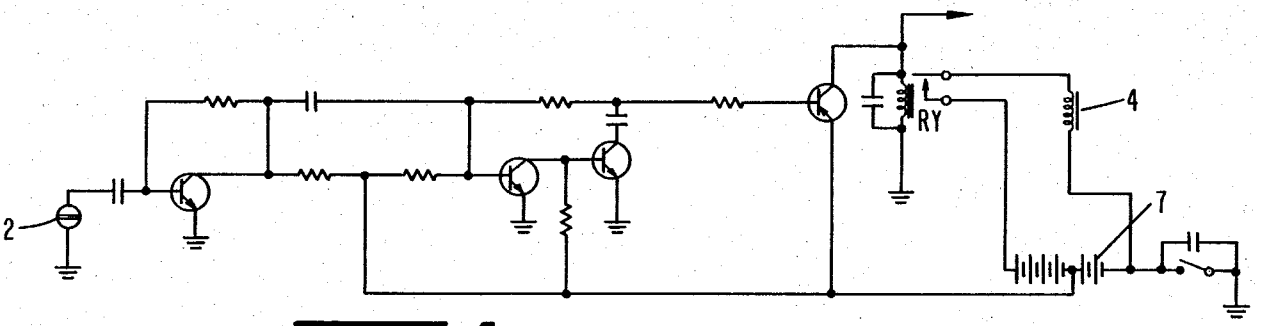
FIG. 2*c* is a circuit diagram of an infrared ray responsive amplifier.

In FIG. 2*c,* the output of light receiving sensor 2 is amplified by photoelectric amplification circuit 3, incorporated together with a scoring and lighting system within a case (not shown) made of an electrically insulating material. The circuit is energized by a battery 7 and is controlled by an on/off switch SW.

To provide a score display, there are two requirements. The first requirement is to display numerical values 8 in proportion to the flux density of infrared rays L received by light receiving sensors 2. The second is to display the number of times that the target was accurately struck in comparison with the number of times the gun was fired.

Figure 3C:
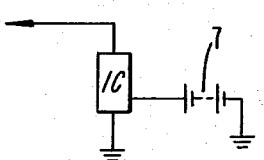
FIG. 3*c* is a simplified circuit diagram of an analog to digital converter for driving the digital display of FIGS. 3*a* and 3*b;*
Figure 3B:
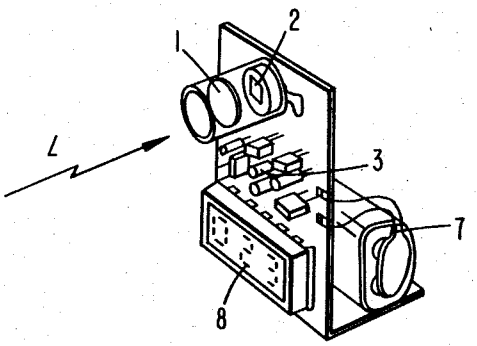
FIG. 3*b* is a perspective view of a numerical display symbolized in FIG. 3*a;*
Figure 3A:
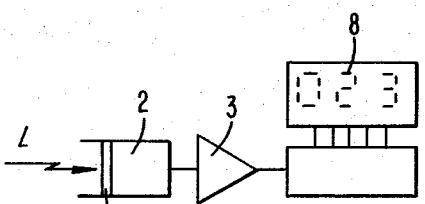
FIG. 3*a* is a circuit diagram of an infrared ray responsive display.

Instantaneous display of score is shown in FIG. 3*a,* with a perspective view of an embodiment shown in FIG. 3*b.* Detailed circuitry for indexing the counter 8 in response to "hits" is shown in FIG. 2*c.*

FIG. 3 illustrates a conventional analog to digital circuit, energized by batter 7, wherein the magnitude of the output of sensor 2, which is a measure of the amount of flux density impinging on the sensor, is converted to a digital signal that is displayed in display 8.

Figure 4A:
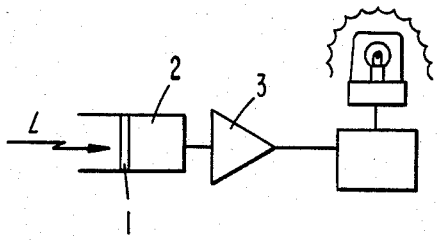
FIG. 4*a* is a circuit diagram of an infrared ray responsive indicator lamp.
Figure 4B:
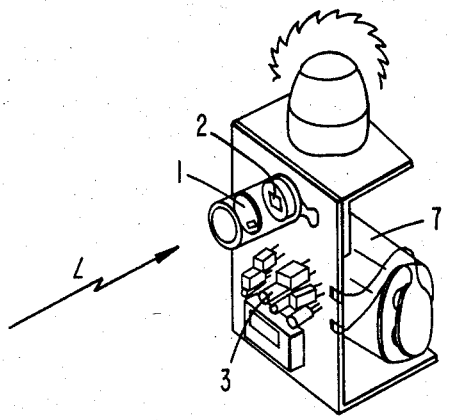
FIG. 4*b* is a perspective view of the lamp assembly.
Figure 4C:
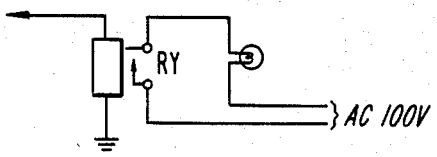
FIG. 4*c* is a block diagram of a delay timer circuit for maintaining the lamp energized for a predetermined time.

In FIG. 4*a,* the output of sensor 2 is amplified in photoelectric amplifier 3 to energize a display lamp. A perspective view of an embodiment of the lamp and associated circuitry shown in FIG. 4*b,* and a delay timer for maintaining the lamp on for a predetermined period of time after the sensor is "struck" is shown in FIG. 4*c.*

Thus, in accordance with the invention, infrared rays L are discharged from a model gun simultaneously with the sound of a shot and the appearance of a flame as the gun powder cap explodes. This enables the player to enjoy the actual feel of a firing revolver, providing a greater degree of realism than is possible using a pistol that emits only an optical beam. The elegant external appearance and design of the gun are preserved since the gun does not require any heavy electrical or mechanical devices, such as an incandescent lamp, for generating a visible light beam. Thus, although the model gun does not use live ammunition, the player satisfies his psychological desire to shoot bullets by discharging infrared rays out toward the target while retaining an actual gun feel.

In addition to functioning as an amusement device, the invention has utility in marksmanship training providing safety as compared to conventional training guns.

Another advantage of the invention is that assembly of the target is easy because all components are conventionally available, and the target is portable.

In this disclosure, there is shown and described only the preferred embodiments of the ivnention, but as aforementioned, it is to be udnerstood that the invention is capable of use in various other combinations and environments and is capable of changes or modifications within the scope of the inventive concept as expressed herein.

I claim:

1. An infrared light responsive target, suitable for use with an aimed infrared light emitting target gun, comprising:

means for detecting the intensity of an aimed infrared light emission from said target gun;

means for transducing only said detected infrared light emission in excess of a predetermined level of intensity into a contemporaneous mechanical impulse; and a tangible object responding to said mechanical impulse to simulate a tangible impact thereon.

2. An infrared light responsive target according to claim 1, further comprising:

means for converting said detected intensity of infrared light into an optically perceptible first signal representing a corresponding numerical score.

3. An infrared light responsive target according to claim 2, further comprising:

means for presenting an optically perceptible second signal representing a ratio formed by dividing the number of said stored numerical scores that exceed a predetermined numerical value by the total number of aimed infrared light emissions detected.

4. An infrared light responsive target, suitable for use with an aimed infrared light emitting target gun, comprising:

means for detecting the intensity of an aimed infrared light emission from said target gun;

means for converting said detected intensity of infrared light into an optically perceptible first signal representing a corresponding numerical score;

means for storing successive numerical scores; and means for presenting an optically perceptible second signal representing a ratio formed by dividing the number of said stored numerical scores that exceed a predetermined numerical value by the total number of aimed infrared light emissions detected.

5. A simulated firearm shooting practice system including a simulated firearm and a practice target, comprising:

a simulated firearm comprising an aimable barrel, an actuating trigger and means for generating a trigger-actuated emission of infrared light directed forwardly along a line of fire aligned with said aimable barrel; and an infrared light responsive target comprising means for detecting the intensity of an aimed infrared light emission from said simulated firearm, means for transducing only said detected infrared light emission in excess of a predetermined level of intensity into a contemporaneous mechanical impulse, and a tangible object responding to said mechanical impulse to simulate a tangible impact thereon.

6. A simulated firearm shooting practice system according to claim 5, further comprising:

a plurality of explodable charges explodable by said actuating trigger of said simulated firearm, whereby said emission of infrared light is emitted coincident with the explosion of one of said explodable charges by said simulated firearm.

7. A simulated firearm shooting practice system according to claim 6, wherein:

said explosion of said explodable charge is the sole source of said emission of infrared light.

8. A simulated firearm shooting practice system including a simulated firearm and a practice target, comprising:

a simulated firearm comprising an aimable barrel, an actuating trigger and means for generating a trigger-actuated emission of infrared light directed forwardly along a line of fire aligned with said aimable barrel;

an infrared light responsive target comprising means for detecting the intensity of an aimed infrared light emission from said simulated firearm, means for converting said detected intensity of infrared light into an optically perceptible first signal representing a numerical score corresponding to the intensity detected, means for presenting an optically perceptible second signal representing a ratio formed by dividing the number of said stored numerical scores that exceed a predetermined numerical value divided by the total number of aimed infrared light emissions detected.

9. A simulated firearm shooting practice system according to claim 8, wherein:

said infrared light responsive target further comprises means for transducing only said detected infrared light emission in excess of a predetermined level of intensity into a contemporaneous mechanical impulse, and a tangible object responding to said mechanical impulse to simulate a tangible impact thereon.

10. A simulated firearm shooting practice system according to claim 8, further comprising:

a plurality of explodable charges explodable by said actuating trigger of said simulated firearm, whereby said emission of infrared light is emitted coincident with the explosion of one of said explodable charges by said simulated firearm.

11. A simulated firearm shooting practice system according to claim 10, wherein:

said explosion of said explodable charge is the sole source of said emission of infrared light.

* * * * *